United States Patent [19]

Maron

[11] Patent Number: 4,958,517

[45] Date of Patent: Sep. 25, 1990

[54] APPARATUS FOR MEASURING WEIGHT, TORQUE AND SIDE FORCE ON A DRILL BIT

[75] Inventor: Robert Maron, Cromwell, Conn.

[73] Assignee: Teleco Oilfield Services Inc., Meriden, Conn.

[21] Appl. No.: 390,155

[22] Filed: Aug. 7, 1989

[51] Int. Cl.[5] ..... E21B 47/00

[52] U.S. Cl. ..... 73/151; 175/40

[58] Field of Search ..... 73/151, 151.5, 862.19, 73/862.54, 862.65; 166/250; 175/39, 40

[56] References Cited

U.S. PATENT DOCUMENTS

| | | | |
|---|---|---|---|
| 3,864,968 | 2/1975 | Anderson | 73/151 |
| 4,359,898 | 11/1982 | Tanguy et al. | 73/151 |
| 4,715,451 | 12/1987 | Bseisu et al. | 73/151 |

*Primary Examiner*—John Chapman

*Assistant Examiner*—Kevin D. O'Shea

*Attorney, Agent, or Firm*—Fishman, Dionne & Cantor

[57] ABSTRACT

Apparatus is presented for measuring weight, torque and side force (bending) on a drill bit for oil and gas well drilling. This apparatus includes radial holes which do not pass completely through the wall of the drill collar sub, but instead, pass only partially through the wall of the drill collar sub. Strain gages are located in the partial radial openings. These strain gages measure each of the three parameters of weight, torque and bending. Each partially formed hole is sealed by a plug and retained in place by a retaining ring. For torque and bending measurements, the strain gages are arranged with symmetry of position between diametrically opposed holes. The strain gages are positioned in an array which departs from symmetry of position to minimize errors in the weight measurement caused by pressure changes in the drilling fluid.

24 Claims, 2 Drawing Sheets

APPARATUS FOR MEASURING WEIGHT, TORQUE AND SIDE FORCE ON A DRILL BIT

This invention relates to the field of borehole measurements. More particularly, this invention relates to new and improved apparatus for measuring weight, torque and side forces on a drill bit.

This invention is intended to be an improvement to a known apparatus for measuring weight, torque and side force on a drill bit disclosed in U.S. Pat. No. 4,821,563 which is assigned to the assignee hereof and fully incorporated herein by reference. The apparatus of U.S. Pat. No. 4,821,563 is located in a short tubular member (a drill collar sub) connected to the bottom of a measurement-while-drilling (MWD) tool, which is then is located as closely as possible above the drill bit. Sensing elements consisting of foil type electrical resistance strain gages are mounted on the peripheral walls of radially oriented cylindrical holes in the sub wall to sense the load induced strains in the material. The gages for each type of measurement are connected in a bridge configuration and are positioned so that the bridge is sensitive essentially only to the type of loading that is being measured, and is insensitive to the other two types of loading (i.e., the weight-on-bit (WOB) measurement is essentially not affected by torque or bending, torque-on-bit (TOB) measurement is essentially not affected by weight or bending and bending-force-on-bit (BOB) measurement is essentially not affected by weight or torque).

An important feature of U.S. Pat. No. 4,821,563 is that the mounting holes for the strain gages pass completely through the sub and so communicate directly between the outside and the interior of the sub. The diametrically opposed through holes are sealed by inner and outer plugs in a ring and bolt structure which retains the plugs in place. While well suited for its intended purposes, the through hole construction of U.S. Pat. No. 4,821,563 gives rise to several disadvantages. For example, should the inner plug fail, leakage of drilling fluid from the interior of the drill collar would cause failure to both the strain gage sensing apparatus as well as cause damage to the sub itself and the entire drilling operation. Also, the need for the central support ring within the inner diameter of the drill collar for retaining the inner seal plug causes an undesirable obstruction of the inner diameter of the drill collar.

SUMMARY OF THE INVENTION

The above discussed and other drawbacks and deficiencies of the prior art are overcome or alleviated by the new and improved apparatus for measuring weight, torque and side force on a drill bit of the present invention. In accordance with the present invention, the measuring and sensing apparatus of the U.S. Pat. No. 4,821,563 is utilized in a pair of diametrically opposed radial openings which are formed only partially through the drill collar sub and so do not extend completely through the drill collar sub as in the prior art structure. Each opening is provided with a specially shaped outer plug which forms an annular atmospheric chamber in which the strain gages are located. Each plug is retained in its associated opening by a retaining ring. It will be appreciated that because the atmospheric chamber is pressurized to one atmosphere, when the drilling sub containing the measuring apparatus is located downhole, the high pressure environment in the borehole will retain the plug within the opening in the drill collar sub and thereby prevent the plug from dislodging (not withstanding the presence of the retaining ring).

The partial radial openings and associated single plug construction of the measuring apparatus of the present invention leads to several important features and advantages relative to the prior art construction disclosed in U.S. Pat. No. 4,821,563. For example, the construction of the present invention eliminates at least four different elements required in the previous construction including the central support ring, the inner seal plug, the plug fastener bolt and the several sealing gaskets and O-rings. This construction therefore leads to a simpler, more reliable and less costly design. Also, by removing the central support ring, any obstruction in the inner diameter of the drill collar sub is also eliminated. Yet another feature of this invention is that by not drilling the hole completely through the drill collar sub, there is eliminated any chance of leakage known as "washout" from the inner diameter to the outer diameter of the drill collar. As mentioned, when this does occur, there is catastrophic failure. Finally, having only a partial opening through the drill collar sub will provide better structural integrity to the drill collar sub wall itself.

The above discussed and other features and advantages of the present invention will be more fully understood and appreciated by one of ordinary skill in the art from the following detailed description and drawings.

BRIEF DESCRIPTION OF THE DRAWINGS:

Referring now to the drawings wherein like elements are numbered alike in the several FIGURES.

Figure 1:
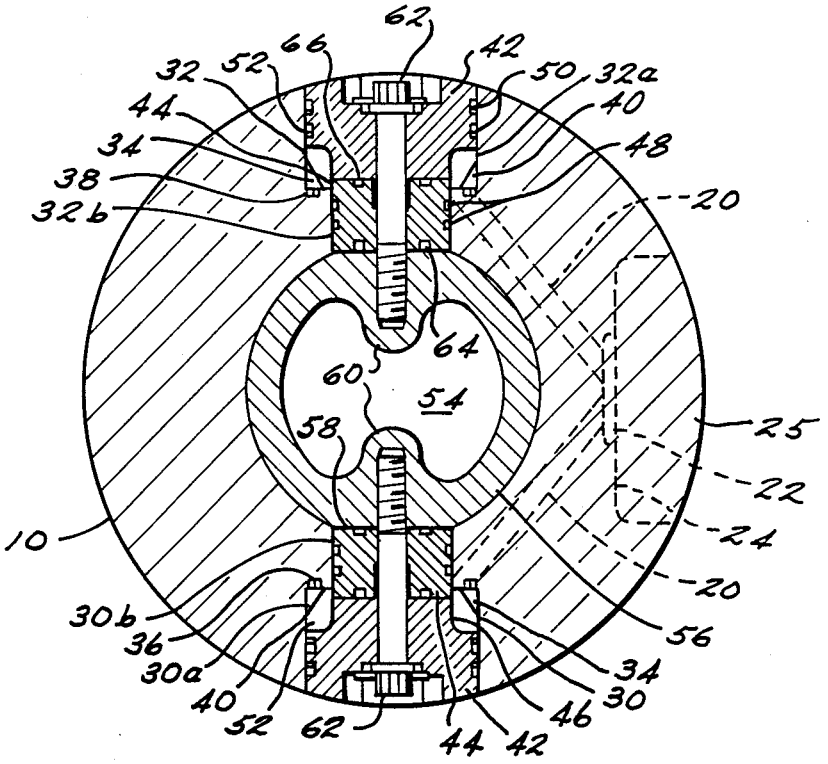
FIG. 1 (PRIOR ART)
FIG. 1 is a cross-sectional elevation view of a drill collar sub in accordance with the prior art apparatus for measuring weight, torque and side force on a drill bit of U.S. Pat. No. 4,821,563.

DESCRIPTION OF THE PREFERRED EMBODIMENT:

Referring first to FIG. 1, a cross-sectional elevation view of an apparatus for measuring weight, torque and side force on a drill bit in accordance with prior U.S. Pat. No. 4,821,563 is shown. It will be appreciated that prior art FIG. 1 corresponds and is identical to FIG. 3A of U.S. Pat. No. 4,821,563. For ease of understanding, the reference numerals used in FIG. 1 are identical to the reference numerals used in FIG. 3A of the prior patent.

Referring now in detail to prior art FIG. 1, sub 10 has a pair of diametrically opposed radially extending circular through holes 30 and 32. Each of the holes has a large diameter outer section 30*a* and 32*a* and a smaller diameter inner section 30*b* and 32*b*. An array of strain gages are mounted on the cylindrical walls of large hole sections 30*a* and 32*a* in the general vicinity indicated at 34. Connecting wires run from the strain gages in annular recesses 36 and 38 and at the base of each large diameter section, and those wires then run along the drilled holes to connect to the circuit board 22 in recess 24. The strain gages and wires in recesses 36 and 38 may be covered by a potting compound 40 to secure them in place and protect them from damage.

Each hole has an outer seal plug 42 (with an OD to match the ID of the large hole section) and an inner seal plug 44 (with an O.D. to match the ID of the reduced small hole). Outer plug 42 has a reduced diameter section 46 of diameter equal to the diameter of inner plug 44. The inner and outer plugs meet and butt against each other at flat facing surfaces. Each pair of plugs cooperate to define an annular atmospheric chamber 52 in which the strain gages are located. The plugs are made of the same material as sub 10, i.e., preferably beryllium copper material. "O" ring seals 48 and 50 seal the OD of plugs 42 and 44, respectively, relative to the walls of the hole sections to prevent leakage of external fluids from the borehole annulus (between the exterior of the drillstring and the wall of the borehole) or from the internal bore 54 of the drillstring into chamber 52.

An internal metal ring 56 (again preferably of the same material as sub 10) is located in drillstring centerbore 54, and ring 56 has a cylindrical OD around most of its periphery to form a loose fit with the ID of the center bore of the drillstring sub 14. Ring 56 has opposed flat surfaces 58 against which flat inboard facing surfaces of plug segments 44 meet and butt. Ring 56 also has a pair of inwardly projecting flanges 60 to receive plug fastener bolts 62. The bolts 62 fasten and secure the plug segments in place. An "O" ring 64 at the inboard face between each plug 44 and the flat 58 on ring 56 provides additional sealing against leakage from the centerbore of sub 10 into atmospheric chamber 52 or to the borehole annulus; and an "O" ring seal 66 at the flat abutting surfaces between plug segments 42 and 44 to further seal against leakage from the borehole annulus into atmospheric chamber 52.

Figure 2:
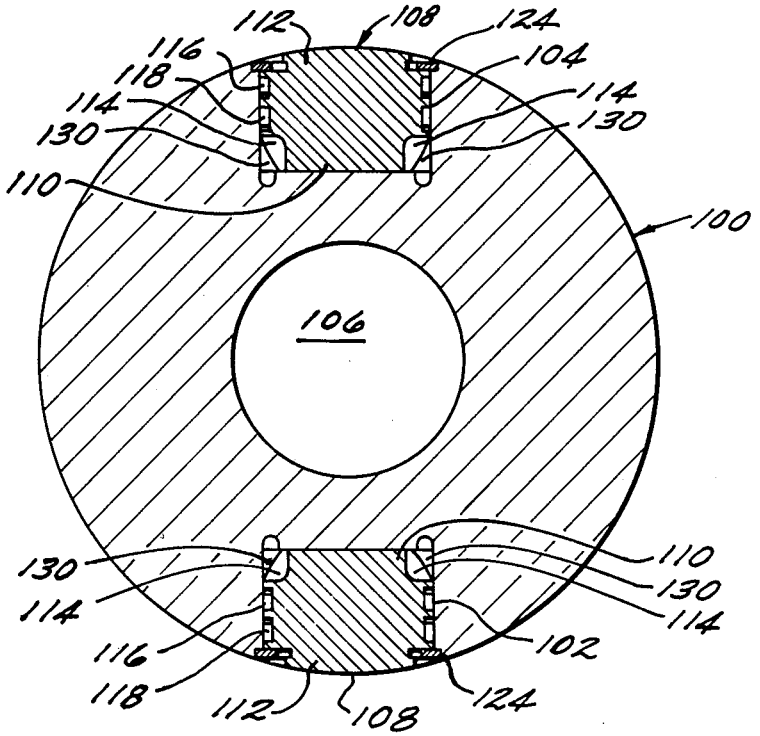
FIG. 2 is a cross-sectional elevation view through a drill collar sub in accordance with the present invention.
Figure 3:
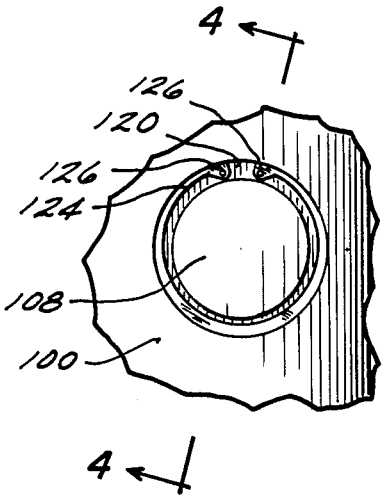
FIG. 3 is a top plan view, partially cut-away showing the plug, retaining ring and opening of FIG. 2.
Figure 4:
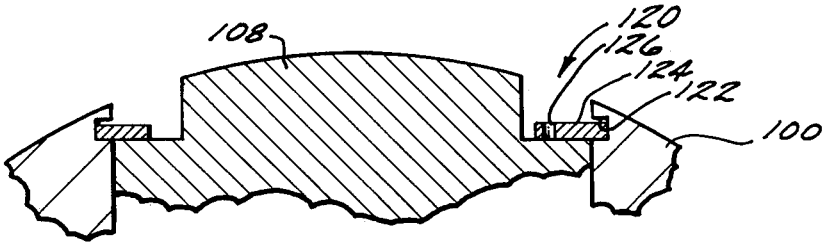
FIG. 4 is a cross-sectional elevation view along the line 4—4 of FIG. 3.

Turning now to FIGS. 2 and 3, in accordance with the present invention, an apparatus for measuring weight, torque and side force on a drill bit is provided to a measuring sub 100 in a similar manner as in FIG. 1 with a significant exception being that the present invention includes a pair of diametrically opposed radial extending circular openings 102 and 104 which do not pass all the way through the sub. In other words, rather than the through holes 30 and 32 of prior art FIG. 1, in accordance with the present invention, openings 102 and 104 are formed only partially through sub 100 and do not communicate with the interior drillstring centerbore 106. Each hole 102, 104 has a sealed plug 108 having a reduced diameter section 110 and a larger diameter section 112 which is equal to the diameter of openings 102 and 104. The reduced diameter section 110 of plug 108 cooperate with the walls of openings 102 and 104 to define an annular atmospheric chamber 114 in which the stain gages are located. Both the sub 100 and plugs 108 are made of the same material (i.e, preferably beryllium copper). O-ring seals 116 and 118 seal the outer diameter of plugs 108 relative to the walls of the partial holes 102, 104 to prevent leakage of external fluids from the borehole annulus (between the exterior of the drillstring and the wall of the borehole). As shown in FIG. 3, the top face of each plug 108 has a reduced diameter relative to openings 102 and 104 so as to define a gap 120. Along the inner walls of opening 102 and 104 and spaced downwardly from the outer surface of sub 100 is a groove 122 which is best shown in FIG. 4. After plug 108 has been disposed in each opening 102 and 104, a known C-shaped retaining ring 124 is positioned in gap 120 using a suitable hand tool (which has been mated with two apertures 126 in ring 124) and then released from the hand tool such that the ring will spring outwardly and be retained within groove 122 as shown in FIG. 4. In this way, ring 124 will be superimposed over the mating surfaces of plug 108 and the openings 102 or 104 of sub 100 to thereby retain plug 108 within the openings As in the prior art construction in FIG. 1, the apparatus of the present invention includes an array of strain gages which are mounted in the annular atmospheric chamber 114. Connecting wires run from the strain gages, and those wires then run along the drilled holes to connect to the circuit board as described in U.S. Pat. No. 4,821,563. The strain gages and wires in annular chambers 114 may be covered by potting compound 130 to secure them in place and protect them from damage.

It will be appreciated that the depth of openings 102 and 104 must be large enough to provide an adequate annular space for retaining the strain gages therein and yet not harm the mechanical integrity of drill collar 100. Also, because the inner diameter of drill collars wear over time from the drilling fluid, the spacing between the partial opening 102 or 104 and the inner bore 106 should be large enough to anticipate wearing over time.

Preferably, the annular chamber 114 remains sealed at the one atmosphere of pressure present at assembly. Thus, when the drillstring is in a borehole, the high pressure environment in the borehole will maintain plugs 108 tightly within openings 102 and 104. Of course, at the surface, retaining rings 128 will maintain plugs 108 within openings 102 and 104.

In accordance with the present invention of FIG. 2 and the prior art structure of FIG. 1, each of the three measurements (WOB, TOB, BOB) uses an array of four strain gages connected in a bridge configuration. Six strain gages are bonded in precisely determined arrays to the cylindrical walls in the chambers 114. In each case (i.e., for measurement of WOB, TOB and BOB), two of the strain gages are mounted in the atmospheric chamber of hole 102 and two strain gages are mounted in the atmospheric chamber of hole 104. The gages sense strain, or elastic deformation in the walls of the holes to which they are bonded. The strains are proportional to the loads applied to the sub. The strains result in changes in the electrical resistance of the strain gages. In the bridge circuit, this produces an output measurement voltage proportional to the strain.

Other than the novel partial openings 102 and 104 and associated structure, the remaining features of the present invention are identical to that described in U.S. Pat. No. 4,821,563 and reference should be made to that patent for a description of the manner of operation of the present invention.

It will be appreciated that the improvement of the present invention shown in FIG. 2 provides certain advantages and features relative to the prior art apparatus shown in FIG. 1. One important advantage is that the present invention eliminates the central support ring 56, the inner seal plug 44, the plug fastener bolts 62 and the several sealing gaskets and O-rings 48, 64 and 66 used by the prior art apparatus. The elimination of all of these components lead to a more simple, more reliable and less costly apparatus relative to the prior art.

Also, by removing central ring 56 and allowing borehole annulus 106 to be free of obstruction, the present invention allows improved mud flow relative to the prior art.

The present invention also eliminates any chance of leakage or washout from the borehole interior 106 to the outer diameter of the drill collar because there is no longer any inner plug which may be damaged in any way. Thus, the present invention is less likely to fail or become damaged relative to the prior art construction of FIG. 1. Similarly, the fact that the openings 102 and 104 of the present invention are only partially through the drill collar sub 100 maintains the integrity and strength of the sub wall as opposed to openings formed completely through the sub wall.

It will be appreciated that there is a trade-off in the formation of partial openings in accordance with the present invention relative to a through hole opening as in the prior art. In the partial or blind hole of the present invention, there will be slightly less strain occurring as a result of an applied load relative to an identical through hole opening of the prior art. This results in a slightly lower output signal from the strain gage bridge in the present invention relative to the prior art. However, while slightly lower than the prior art, the output signal derived from the present invention is nevertheless adequate for its intended use.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for measuring at least one load applied to a drill bit during the drilling of a well, including:

drillstring sub means adapted to be connected in a drillstring above the drill bit;

a pair of diametrically opposite openings extending only partially through the wall of said sub from an outer surface of said sub means;

plug means in each of said openings, said plug means cooperating with said openings to define an atmospheric chamber means in each of said openings;

weight sensor means in each of said opening for generating an output in response to at least the parameter of weight on the drill bit; and said weight sensor means including first weight sensor means positioned at a first predetermined position and in a first predetermined orientation in each opening to sense the effects of weight; and second weight sensor means in each opening positioned at a second predetermined position relative to the first sensor means and in a second orientation relative to the orientation of said first sensor means to cancel the effect of pressure differential across said drillstring sub.

2. Measuring apparatus as in claim 1 wherein:

said second predetermined position of each of said second sensor means is selected to establish bending symmetry and cancel the effects of bending loads.

3. Measuring apparatus as in claim 2 wherein:

said second predetermined position of each of said second sensor means is selected to establish torque symmetry and cancel the effects of torque loads.

4. Measuring apparatus as in claim 1 wherein:

the positions of said first weight sensor means in each of said chambers are symmetrical; and the positions of said second weight sensor means in each of said chambers is asymmetrical.

5. Measuring apparatus as in claim 1 including:

torque sensor means in each of said chamber means for generating an output in response to the parameter of torque load on the drill bit.

6. Measuring apparatus as in claim 5 wherein:

said torque sensing means includes first and second torque sensing means in each chamber means, said first and second torque sensing means being positioned at first and second predetermining torque sensing positions in each chamber, said first and second predetermined torque sensing positions in one chamber being symmetrical with respect to said first and second predetermined torque sensing positions in the other chamber.

7. Measuring apparatus as in claim 1 including:

bending sensor means in each of said chamber means for generating an output in response to the parameter of bending load on the drill bit.

8. Measuring apparatus as in claim 7 wherein:

said bending sensing means includes first and second bending sensing means in each chamber means, said first and second bending sensing means being positioned at first and second predetermined bending sensing positions in each chamber, said first and second predetermined bending sensing positions in one chamber being symmetrical with respect to said first and second predetermined bending sensing positions in the other chamber.

9. Apparatus for measuring at least one load applied to a drill bit during the drilling of a well, including:

drillstring sub means adapted to be connected in a drillstring above the drill bit;

a pair of diametrically opposite openings extending only partially through the wall of said sub means from an outer surface of said sub means;

Plug means in each of said openings, said plug means cooperating with said openings to define an atmospheric chamber means in each of said openings;

first and second weight sensor strain gages in each of said chambers for generating electrical outputs in response to loads thereon;

said first weight sensor strain gage in each hole being positioned at a first predetermined position and in a first predetermined orientation to sense the effects of weight;

said second weight sensor strain gage in each chamber being positioned at as second predetermined position angularly displaced relative to the first weight sensor strain gage and with its sensitive axis angularly rotated relative to the sensitive axis of the first weight sensor strain gage to cancel the effects of pressure differential across said drill string sub; and said first and second weight sensor strain gages in each chamber being connected in a bridge circuit with the first weight sensitive strain gages of each chamber being in a first pair of opposed arms of said bridge circuit and the second weight sensitive strain gages of each chamber being in a second pair of opposed arms of said bridge circuit.

10. Measuring apparatus as in claim 9 wherein:

said second predetermined position of each of said second weight sensor strain gages is selected to establish bending symmetry and cancel the effects of bending loads.

11. Measuring apparatus as in claim 10 wherein:

said second predetermined position of each of said second weight sensor strain gages is selected to establish torque symmetry and cancel the effects of torque loads.

12. Measuring apparatus as in claim 9 wherein:

the positions of said first weight sensor strain gage in each of said chambers are symmetrical; and the positions of said second weight sensor strain gage in each of said chambers is asymmetrical.

13. Measuring apparatus as in claim 9 including:

torque sensor strain gages in each of said chambers for generating an output in response to the parameter of torque load on the drill bit.

14. Measuring apparatus as in claim 9 including:

first and second torque sensor strain gages in each chamber, said first and second torque sensor strain gages being positioned at first and second predetermined torque sensing positions in each chamber, said first and second predetermined torque sensing positions in one chamber being symmetrical with respect to said first and second predetermined torque sensing positions in the other chamber.

15. Measuring apparatus as in claim 14 including:

bending sensor strain gages in each of said chambers for generating an output in response to the parameter of bending load on the drill bit.

16. Measuring apparatus as in claim 9 including:

first and second bending sensor strain gages in each chamber, said first and second bending sensor strain gages being positioned at first and second predetermined bending sensing positions in each chamber, said first and second predetermined bending sensing positions in one chamber being symmetrical with respect to said first and second predetermined bending sensing positions in the other chamber.

17. Measuring apparatus as in claim 14 including:

said first and second torque sensor strain gages in each chamber being connected in a bridge circuit with the first torque sensor strain gages of each chamber being in a first pair of opposed arms of said bridge circuit and the second torque sensor strain gages of each chamber being in a second pair of opposed arms of said bridge circuit.

18. Measuring apparatus as in claim 16 including:

said first and second bending sensor strain gages in each chamber being connected in a bridge circuit with the first and second bending sensor strain gages of each chamber being in a first pair of adjacent arms of said bridge circuit and the second bending sensor strain gages of each chamber being in a second pair of adjacent arms of said bridge circuit.

19. Apparatus for measuring at least one load applied to a drill bit during the drilling of a well, including:

drillstring sub means adapted to be connected in a drillstring above the drill bit;

a pair of diametrically opposite openings extending only partially through the wall of said sub means;

means defining an atmospheric chamber means in each of said openings;

weight sensor means in each of said chamber means for generating an output in response to at least the parameter of weight on the drill bit; and said weight sensor means including first weight sensor means positioned at a first predetermined position and in a first predetermined orientation in each chamber means to sense the effects of weight; and second weight sensor means in each chamber means positioned at a second predetermined position relative to the first sensor means and in a second orientation relative to the orientation of said first sensor means to cancel the effects of pressure differential across said drill string sub.

20. Measuring apparatus as in claim 19 wherein:

said second predetermined position of each of said second sensor means is selected to establish bending symmetry and cancel the effects of bending loads.

21. Measuring apparatus as in claim 19 wherein:

said second predetermined position of each of said second sensor means is selected to establish torque symmetry and cancel the effects of torque loads.

22. Measuring apparatus as in claim 19 wherein:

the positions of said first weight sensor means in each of said chambers are symmetrical; and the positions of said second weight sensor means in each of said chambers is asymmetrical.

23. Measuring apparatus as in claim 19 including:

torque sensor means in each of said chamber means for generating an output in response to the parameter of torque load on a drill bit.

24. Measuring apparatus as in claim 19 wherein:

said torque sensing means includes first and second torque sensing means in each chamber means, said first and second torque sensing means being positioned at first and second predetermined torque sensing positions in each chamber, said first and second predetermined torque sensing positions in one chamber being symmetrical with respect to said first and second predetermined torque sensing positions in the other chamber.

* * * * *